US006343914B1

(12) United States Patent
Ferber et al.

(10) Patent No.: US 6,343,914 B1
(45) Date of Patent: Feb. 5, 2002

(54) FLUID-FLOW MACHINE COMPONENT

(75) Inventors: Jörgen Ferber, Küssaberg; Rudolf Kellerer, Waldshut, both of (DE); Mark McCarthy, Baden; Beat von Arx, Trimbach, both of (CH)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 09/499,399

(22) Filed: Feb. 7, 2000

(30) Foreign Application Priority Data

Feb. 10, 1999 (EP) ..... 99810111

(51) Int. Cl.[7] ..... F01D 5/22
(52) U.S. Cl. ..... 416/193 A; 416/248
(58) Field of Search ..... 416/191, 193 A, 416/248

(56) References Cited

U.S. PATENT DOCUMENTS 3,014,695 A * 12/1961 Rankin et al. ..... 416/220 R
4,676,723 A * 6/1987 Kiger et al. ..... 416/221
4,815,938 A * 3/1989 Brown ..... 416/190
5,443,365 A 8/1995 Ingling et al.
5,853,286 A 12/1998 Bussonnet et al.
6,030,178 A * 2/2000 Caruso ..... 416/200 R

FOREIGN PATENT DOCUMENTS

GB 2 162 588 A 2/1986
JP 6-129203 * 5/1994

OTHER PUBLICATIONS

European Search Report 99/024 EP dated Aug. 7, 1999.

* cited by examiner

*Primary Examiner*—Edward K. Look
*Assistant Examiner*—Ninh Nguyen
(74) *Attorney, Agent, or Firm*—Burns, Doane, Swecker & Mathis, L.L.P.

(57) ABSTRACT

A component of a fluid-flow machine including a flow-deflecting device which is connected in a root region to a platform, the penetration of the flow-deflecting device with the platform being provided by a pressure-side profile line, a suction-side profile line, and a leading edge base point and a trailing edge base point, and the top view of the platform essentially exhibiting the shape of a parallelogram on which there is arranged a nose running in the circumferential direction, wherein a long side of the parallelogram is arranged as a tangent to the suction-side profile line.

9 Claims, 2 Drawing Sheets

FLUID-FLOW MACHINE COMPONENT

TECHNICAL FIELD

The invention relates to a component of a fluid-flow machine, essentially comprising a flow-deflecting device which is connected in a root region to a platform, the penetration of the flow-deflecting device with the platform being provided by a pressure-side profile line, a suction-side profile line, and a leading edge base point and a trailing edge base point, and the top view of the platform essentially exhibiting the shape of a parallelogram on which there is arranged a nose running in the circumferential direction.

BACKGROUND OF THE INVENTION

The blades of modern gas turbines are subjected to high mechanical loads because of centrifugal forces, aerodynamic forces and thermal stresses. Subjected in particular to extremely high loads is the blade transition, that is to say the region in which the actual flow-deflecting devices merge into the platforms. The entire torque induced by aerodynamic forces must be transmitted at this point, and in the case of blades their centrifugal load also has to be withstood. In the case of high hot-gas temperatures and, in particular, when the components are being cooled, it is precisely in the region of the transition from the blade to the platform that high temperature gradients continue to have to be taken into account.

In top view, such platforms of blades are mostly presented as parallelograms of which two sides are orientated in the circumferential direction of the machine, while the two other sides run approximately in the direction of the mean flow angle. A nose running in the circumferential direction is mostly arranged at an end situated downstream. In the installed state, the noses of a platform respectively engage in a corresponding cutout in another component, and thereby seal the interspace of the platforms in the flow direction.

The penetration line of the blade, which is essentially to be characterized by a suction-side and pressure-side profile line as well as a trailing edge base point and a leading edge base point, is situated inside the surface thus described. On their underside, the platforms bear devices for the purpose of anchoring the components in the housing or on the shaft, and therefore constitute a very solid and thus also stiff structure.

From the top view of the configuration thus described the person skilled in the art recognizes in the transition from the flow-deflecting device to the platform the basic features of a three-point bearing which transmits the torque induced by aerodynamic forces into the platform. The bearing points are in this case the base points of the trailing edge and leading edge, and the suction-side profile line in the region of the maximum curvature.

The introduction of the forces and torques into the stiff platform produces complex three-dimensional states of stress at the said points. Because of the stiffness of the platform, the material cannot compensate the stresses by elastic strains; the abovementioned temperature gradients cause differential strains which likewise cannot take place freely because of the component geometry, and this further increases the loading of the component.

Furthermore, relatively narrow radii must be provided in the transition from the platform to the flow-deflecting device. The result of this is a notch effect and an unfavourable force flux in this region.

Thus, overall strong stresses are induced in a zone in which the material strain is extremely impeded. In particular, when the strength of the material is reduced in any case by high temperatures, the peak stresses occurring limit the service life of a component.

SUMMARY OF THE INVENTION

The invention aims to provide a remedy here. In the case of a component of a fluid-flow machine, essentially comprising a flow-deflecting device which is connected in a root region to a platform, the penetration of the flow-deflecting device with the platform being provided by a pressure-side profile line, a suction-side profile line, and a leading edge base point and a trailing edge base point, and the top view of the platform essentially exhibiting the shape of a parallelogram on which there is arranged a nose running in the circumferential direction, it is the object of the invention to configure the transition from the platform to the flow-deflecting device in such a way that the excessive stresses mentioned in the introduction are avoided as far as possible. In particular, the contour of the component is to be appropriately shaped in the region of the transition from the platform to the flow-deflecting device.

According to the invention, this is achieved, on the one hand, by virtue of the fact that the trailing edge base point of the flow-deflecting device is situated in a corner of the parallelogram.

It is likewise possible within the scope of the invention for the leading edge base point of the flow-deflecting device to be situated in a corner of the parallelogram or, for a long side of the parallelogram to be arranged as a tangent to the suction-side profile line. All three features can be intercombined as desired.

In particular, in conjunction with the placing of the trailing edge base point, it is advantageous when the nose of the platform is arranged at the downstream end of the suction-side long side of the parallelogram of the platform.

BRIEF DESCRIPTION OF THE DRAWING

The invention will be explained below in more detail with the aid of the drawing. Here.

DESCRIPTION OF THE PREFERRED EMBODIMENT

Figure 1:
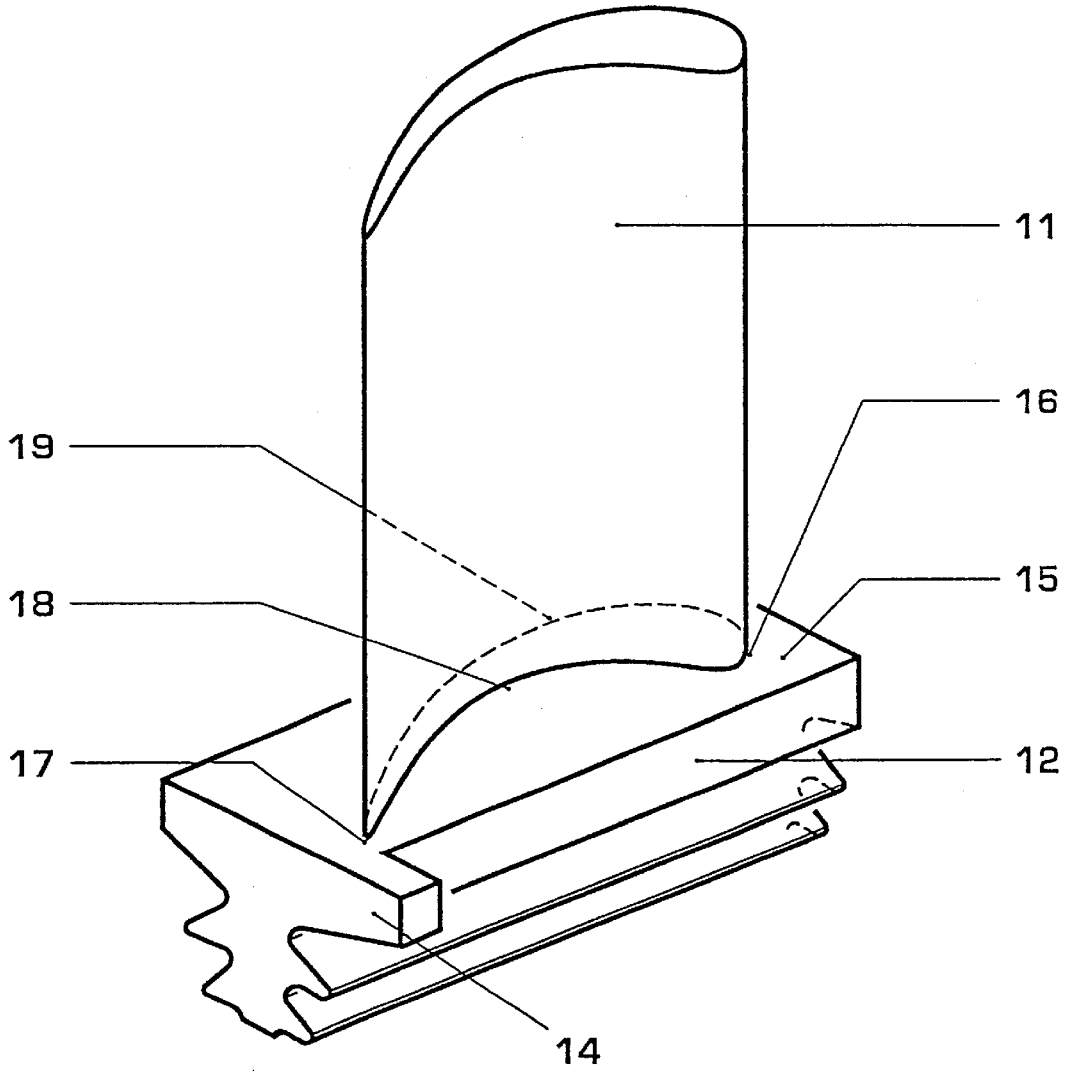
FIG. 1 shows a turbine blade according to the prior art, in a perspective representation.

FIG. 1 shows in a perspective representation a fluid-flow machine component as set forth according to the prior art. The root 12 of the component is provided with a device for fastening in the housing of a fluid-flow machine or on their impellers, and with a platform 15 on which the flow-deflecting device 11 is arranged. A pressure-side profile line 18, a suction-side profile line 19, as well as in each case a base point of the leading edge and of the trailing edge, 16 and 17, respectively, are to be found in the region of the transition from the flow-deflecting device to the root.

The platform is provided with a nose 14 which overlaps with other components in the installed state and has a sealing function.

Figure 2:
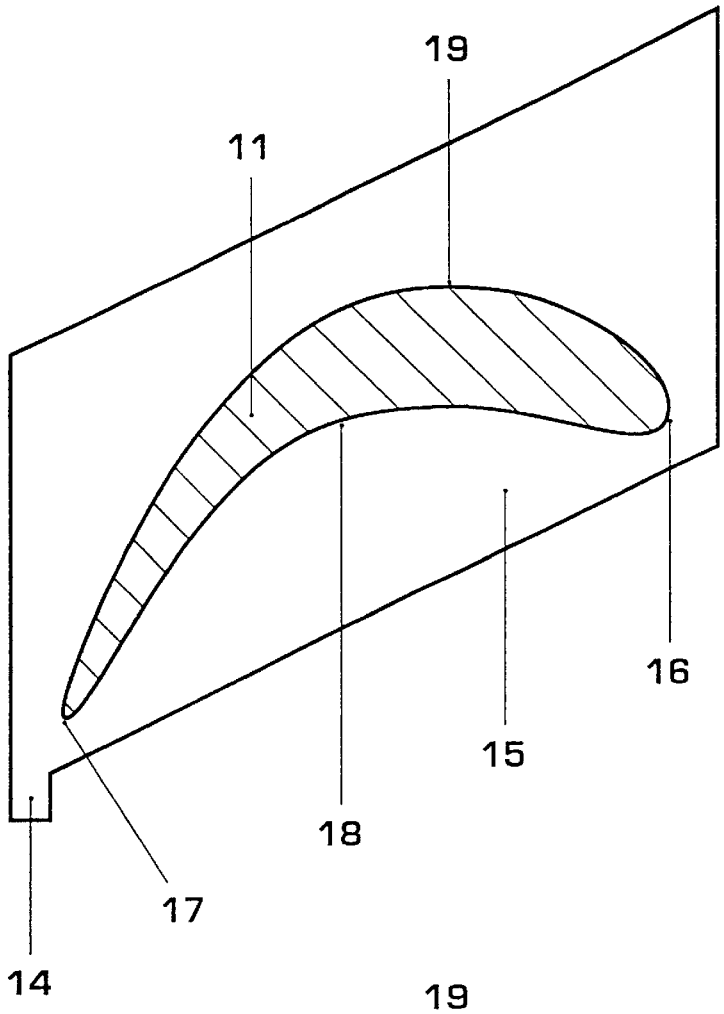
FIG. 2 shows a diagrammatic section through this blade, directly in the region of the transition from the flow-deflecting device to the platform. Finally.

A section through this fluid-flow machine component directly at the transition from the flow-deflecting device to the platform is represented in FIG. 2, the penetration line 18, 19 of the flow-deflecting device 11 with the platform 15 being particularly well in evidence. The disadvantageous stress conditions in this region are discussed in the introduction.

Figure 3:
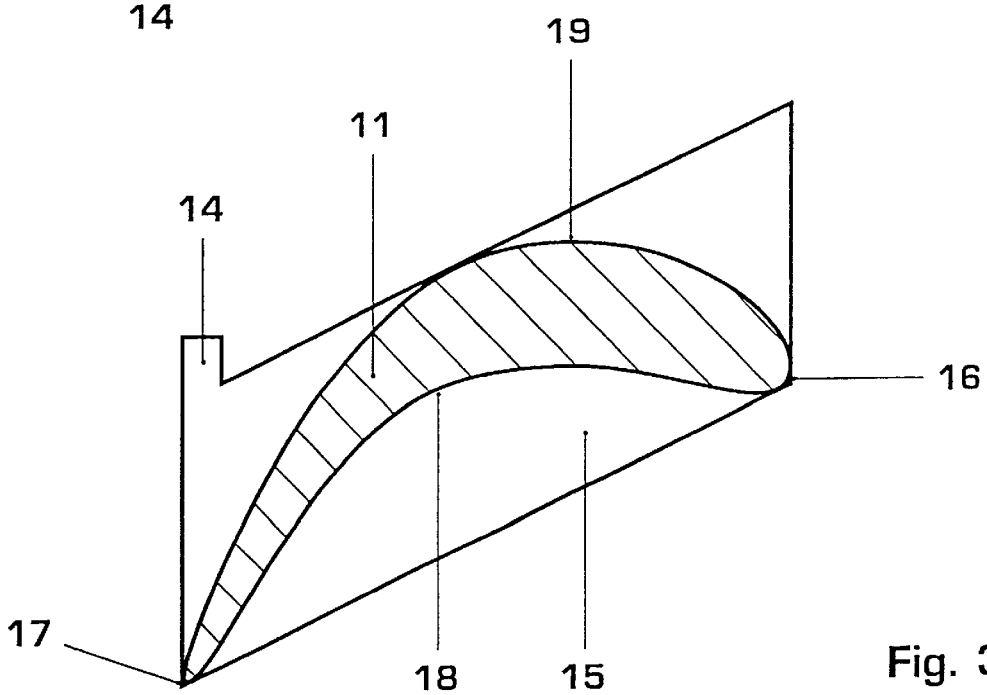
FIG. 3 shows a similar section through a component having all the features essential to the invention.

It may be mentioned at this juncture that the representation of the blades as solid profiles in FIGS. 2 and 3 is purely diagrammatic in nature, and is not to be understood as having a limiting purpose. For example, it is also possible for cooling air channels to be present inside the blade.

A section similar to that represented in FIG. 2 is illustrated in FIG. 3, FIG. 3 representing a component according to the invention with all the features essential to the invention. The platform 15 is shaped such that the leading edge base point 16 and the trailing edge base point 17 of the flow-deflecting device 11 are situated exactly in the corners of the parallelogram, which represents the platform in top view. One platform edge forms a tangent to the suction-side profile line 19. As the person skilled in the art easily recognizes, the result of these measures is a substantially more favourable force flux at those points at which, as discussed in the introduction, the highest stresses occur. By virtue of the fact that these regions of the flow-deflecting device terminate on the outside of the platform, at these points the deformations of the material are less impeded than in the case of a conventional configuration. The platform merges rectilinearly into the flow-deflecting device precisely at the points of maximum load, and the force flux need not be deflected. Peak stresses are thereby absorbed substantially more effectively by elastic strains and excessive stresses are avoided.

Within the scope of the implementation of the features according to the invention, it is, moreover, advantageous for the nose 14 to be provided on the suction side. It is thus rendered substantially simpler in design terms to arrange the trailing edge base point in accordance with the invention.

It should be appreciated by one skilled in the art that the present invention can be embodied in other specific forms without departing from the spirit of the essential character thereof. The presently disclosed embodiments are therefore considered in all respects to be illustrative and not restrictive. The scope of the invention is indicated by the appended claims rather than the foregoing description and all changes which come within the meaning and range of equivalents theseof are intended to be embraced therein.

What is claimed is:

1. A component of a fluid-flow machine, comprising a flow-deflecting device which is connected in a root region to a platform, the penetration of the flow-deflecting device with the platform being provided by a pressure-side profile line, a suction-side profile line, and a leading edge base point and a trailing edge base point, and the top view of the platform essentially exhibiting the shape of a parallelogram, wherein a long side of the parallelogram is arranged as a tangent to the suction-side profile line.

2. The component of the fluid-flow machine according to claim 1, wherein the trailing edge base point of the flow-deflecting device is situated in a corner of the parallelogram.

3. The component of the fluid-flow machine according to claim 1, wherein the leading edge base point of the flow-deflecting device is situated in a corner of the parallelogram.

4. A component of the fluid-flow machine according to claim 1, wherein on the parallelogram-shaped platform there is a nose arranged running in the circumferential direction.

5. The component of the fluid-flow-machine according to claim 4, wherein the nose is arranged at the downstream end of the suction-side long side of the parallelogram of the platform.

6. The component of a fluid-machine, comprising a flow-deflecting device which is connected in a root region to a platform, the penetration of the flow-deflecting device with the platform being provided by a pressure-side profile line, a suction-side profile line, and a leading edge base point and a trailing edge base point, and the top view of the platform essentially exhibiting the shape of a parallelogram, the trailing edge base point of the flow-deflecting device is situated in a corner of the parallelogram;

the leading edge base point of the flow-deflecting device is situated in a corner of the parallelogram; and a long side of the parallelogram is arranged as a tangent to the suction-side profile line.

7. A component of the fluid-flow machine according to claim 6, wherein on the parallelogram-shaped platform there is a nose arranged running in the circumferential direction.

8. The component of the fluid-flow machine according to claim 7, wherein the nose is arranged at the downstream end of the suction-side of the parallelogram of the platform.

9. The component of a fluid-flow machine, comprising a flow-deflecting device which is connected in a root region to a platform, the penetration of the flow-deflecting device with the platform being provided by a pressure-side profile line, a suction-side profile line, and a leading edge base point and a trailing edge base point, and the top view of the platform essentially exhibiting the shape of a parallelogram on which there is arranged a nose running in the circumferential direction, the leading edge base point of the flow-deflecting device is situated in a corner of the parallelogram; and wherein the nose is arranged at the downstream end of the suction-side long side of the parallelogram of the platform.

* * * * *